US006546771B1

(12) United States Patent
Ljungars

(10) Patent No.: US 6,546,771 B1
(45) Date of Patent: Apr. 15, 2003

(54) METHOD FOR MANUFACTURING OF STRIPS AND ROLLING MILL LINE

(75) Inventor: Sten Ljungars, Torshälla (SE)

(73) Assignee: Avestapolarit AB, Stockholm (SE)

( * ) Notice: Subject to any disclaimer, the term of this patent is extended or adjusted under 35 U.S.C. 154(b) by 0 days.

(21) Appl. No.: 09/868,500

(22) PCT Filed: Dec. 8, 1999

(86) PCT No.: PCT/SE99/02293

§ 371 (c)(1),
(2), (4) Date: Jul. 10, 2001

(87) PCT Pub. No.: WO00/37189

PCT Pub. Date: Jun. 29, 2000

(30) Foreign Application Priority Data

Dec. 18, 1998 (SE) ..... 9804443
Oct. 5, 1999 (SE) ..... 9903582

(51) Int. Cl.[7] ..... B21B 45/04; B21C 43/00

(52) U.S. Cl. ..... 72/39; 72/200; 72/201; 72/365.2; 148/608; 148/610

(58) Field of Search ..... 72/39, 200, 201, 72/364, 365.2; 148/608, 610

(56) References Cited

U.S. PATENT DOCUMENTS 4,379,547 A * 4/1983 Shimbashi et al. ..... 266/103
4,885,042 A * 12/1989 Kenmochi et al. ..... 148/610
5,197,179 A 3/1993 Sendzimir et al.
5,554,235 A * 9/1996 Noe et al. ..... 148/610
5,820,704 A * 10/1998 Veyer et al. ..... 148/610
5,830,291 A * 11/1998 McGuire et al. ..... 148/610
5,858,135 A * 1/1999 Niemczura et al. ..... 148/610
5,986,205 A * 11/1999 Matsune et al. ..... 136/258
6,338,762 B1 * 1/2002 Sato et al. ..... 148/325

FOREIGN PATENT DOCUMENTS

DE 195 13 999 A1 10/1996
EP 0 738 781 A1 10/1996
EP 0 837 147 A2 4/1998

* cited by examiner

*Primary Examiner*—Ed Tolan
(74) *Attorney, Agent, or Firm*—Nixon & Vanderhye

(57) ABSTRACT

The invention relates to a method for the manufacturing of strips of stainless steel, comprising cold rolling of a strip which in a foregoing process has been manufactured through casting a melt to form a cast strip and/or has been hot rolled. The cold rolling is performed in a rolling mill line (B), which comprises, in the initial part of the line, at least two initial cold rolling mills (11–13) in series, after said initial cold rolling mills at least one annealing furnace (18) and at least one pickling section (26, 27), and in a terminating part of the line, at least one more cold rolling mill (32). The patent specification discloses various modes of operation, including passing the strip once or twice through the line.

25 Claims, 2 Drawing Sheets

METHOD FOR MANUFACTURING OF STRIPS AND ROLLING MILL LINE

This application is a 35 USC 371 of PCT/SE99/02293 filed Dec. 8, 1999.

TECHNICAL FIELD

The invention relates to a method for manufacturing of strips of stainless steel, comprising rolling in cold condition of strips which in a foregoing process have been manufactured through strip casting and/or have been hot rolled. The invention also relates to a rolling mill line to be used at the carrying out of the method.

BACKGROUND OF THE INVENTION

Cold rolling of stainless steel strips is performed for one or several purposes. The basic purpose is generally to reduce the thickness of the starting strips, which normally have been hot rolled in a foregoing hot rolling line to a thickness of the hot rolled strips, which is not less than 1.5 mm and normally is in the order of 2–4 mm, but can be up to 6 mm. Conventionally, initial annealing, cooling, and descaling shot-blasting as well as pickling in one or more steps precede the cold rolling, for the achievement of a starting material for the cold rolling without oxides and scale residues from the foregoing hot rolling. As an alternative the hot rolling can completely or partly be replaced by manufacturing of strips through casting, which strips may have a thickness down to what is normal for hot rolled strips or be a few millimetres thicker, but also in this case the cold rolling normally is preceded by initial annealing, cooling, descaling shot-blasting, and pickling, to the extent the technique has been implemented at all. At the cold rolling, which conventionally is carried out in a plurality of consecutive cold rolling operations, possibly alternating with annealing, cooling, descaling, and pickling operations, the thickness can be reduced down to 1 mm and in some cases to even thinner gauges. At the same time it is possible to produce, in these conventional cold rolling mills, strips with a very fine surface, a so called 2B-surface, if the rolling is finished by heat treatment, pickling, and skin-pass-rolling, or even finer if bright annealing is employed. A cold rolling also may have as a main purpose or as an additional purpose to increase the strength of the strip material. For this purpose is has also been suggested, as a complement to cold rolling—EP 0 738 781—to cold stretch the strip subsequent to annealing, so that the strip is plasticised and is elongated permanently, at the same time as its thickness is reduced. Further is it known—U.S. Pat. No. 5,197,179 and—EP 0 837 147—to perform at least a first cold rolling operation on the cooled hot rolled strip or on the cooled cast strip prior to heat treatment, pickling, and possible further cold rolling operations in order to bring the strip to desired final gauge. It is, however, characteristic for methods and rolling mill lines known so far that they are expensive and/or difficult to adapt to widely disparate requirements as far as strip thickness, surface conditions, and strength of the final product are concerned. This particularly applies when hot rolling and subsequent cold rolling, as well as operations in connection with the hot rolling and the cold rolling are considered as an integrated process of production.

DISCLOSURE OF THE INVENTION

It is a purpose of the invention to attack and solve the above complex of problems. This, according a first aspect of the invention, can be achieved therein that the cold rolling is performed in a rolling mill line, which comprises, in the initial part of the line, at least two initial cold rolling mills in series, after said initial cold rolling mills at least one annealing surface and at least one pickling section, and in a terminating part of the line, at least one more cold rolling mill, that the cast and/or hot rolled strip, which is dark coloured by oxides on the surfaces of the strip, with the dark coloured oxides remaining on the surfaces of the strip, first is cold rolled in at least one of said initial cold rolling mills so that the thickness of the strip is reduced totally by 10–75%, that the strip then is annealed and pickled in said annealing and pickling sections and is cold rolled in said at least some more cold rolling mill so that its thickness is reduced by 2–20%, that the strip then is fed once more in the same direction through the same rolling mill line, wherein the strip is rolled again in at least one of said initial cold rolling mills so that the strip consecutively is cold rolled in at least one of said more cold rolling mills and in at least one of said initial cold rolling mills, comprising cold rolling in at least three cold rolling mills without intermediate annealing, reducing the thickness by totally 30–75% before the strip again is annealed and pickled. When the strip passes for the second time through the rolling mill line, the strip is preferably rolled again in one of said more cold rolling mills in the terminating part of the rolling mill line, but is this time only skin-pass-rolled, reducing the strip thickness by 0.2–1.5%.

As an alternative, any rolling in the terminating part of the line is excluded as the strip is being passed through the line for the first time, and this is particularly the case if only a skin-pass-rolling mill is provided there, in which case the strip is subjected to rolling in at least three consecutive cold rolling mills in the initial part of the line, as the strip a second time is caused to pass through the line, the strip being reduced by totally 30–75% before the strip again is annealed and pickled and possibly skin-pass-rolled.

The method which has been described above makes manufacturing of strips with very fine surface possible. In order to achieve such a surface it is, however, important that the strip is subjected to descaling prior to pickling, and that such descaling is performed in such a mode that the surfaces are not impaired. Conventionally, descaling is carried out though powerful shot-blasting in one or more steps, a treatment which however results in the undesired damages of the strip surfaces. According to an aspect of the invention, the descaling instead is carried out by bending the strip several times in different directions about rolls, at the same time as the strip is cold-stretched so that it is permanently elongated 2–10% prior to pickling according to a technique which is known per se through said EP 0 738 781. Through this treatment an efficient descaling is achieved without impairing the strip surfaces. This descaling can be completed with a mild shot-blasting, which can be performed before or after the descaling, preferably before aiming at removing only loose oxides in order, through accumulation of oxides, not do disturb subsequent descaling. If the shot-blasting is carried out subsequent to the descaling it is correspondingly achieved that loose oxides are removed, the shot-blasting in each case being carried out in such a mild way that the metallic surfaces of the strip are not impaired.

According to the above described first aspect of the invention, the strip passes twice through the cold rolling mill line. According to another aspect of the invention, this possibility is not utilised in the manufacturing of strips, when the aimed results in the first place are to provide a final product having a high yield strength and surfaces which are fine, even though they do not satisfy the requirements of 2B-quality. According to this aspect of the invention, the invention is characterised in that the cold rolling is performed in a rolling mill line, which comprises, in the initial part of the line, at least two initial cold rolling mills in series, after said initial cold rolling mills at least one annealing section and at least one pickling section, and in a terminating part of the line, at least one more cold rolling mill, that the cast and/or hot rolled strip, which is dark coloured by oxides on the surfaces of the strip, with the dark coloured oxides remaining on the surfaces of the strip, first is cold rolled in at least one of said initial cold rolling mills so that the thickness of the strip is reduced by totally 10–75%, that it then is annealed in at least one annealing furnace in an annealing section, that it subsequent to annealing and rolling is subjected to descaling in at least one descaling unit in which the strip is bent several times in different directions about rollers at the same time as the strip is cold-stretched, so that the strip is permanently elongated 2–10%, wherein the scales are caused to be broken, that the strip then is pickled, and that the pickled strip finally is cold rolled in a non-lubricated condition in said at least one more cold rolling mill reducing the thickness by 2–20%.

As has been mentioned in the foregoing description of the background of the invention, it is conventional to hot roll strips to a final hot rolled strip gauge of 2–4 mm and it may even occur that hot rolling is made all the way down to 1.5 mm. The most complicated part of the hot rolling is the final part, i.e. when one is operating with considerably thin strips. This phase is difficult to control and there are also produced much oxides on the strips in relation to the strip thickness. Further, the yield in production in the hot rolling mill is reduced the more the strip thickness is reduced. In order further to improve the starting material used for the subsequent cold rolling it is also advantageous to quench-cool the strip from the final rolling temperature down to below 500° C. in order on one hand to produce as thin oxides layers as possible and on the other hand to avoid precipitation of grain boundary carbides in the surface layers. In accordance with another aspect of the invention it is the purpose to integrate the initial hot rolling and treatment of the strip in connection with the hot rolling with the subsequent cold rolling in such a mode that there is achieved a good production economy from an overall point of view, with an improved capacity in the hot rolling mill including less risk of bottle necks in the hot rolling mill line, as well as a final product after cold rolling which can satisfy high requirements as far as good quality is concerned. According to this aspect of the invention, the invention relates to a method for manufacturing strips of stainless steel, comprising hot rolling in an initial process and subsequently cold rolling in a rolling mill line, characterised in that the hot rolling is stopped when the strip thickness has been reduced to a thickness between 2.5 and 6 mm, preferably to between 3 and 5 mm, that the thus hot rolled strip is cooled from the final hot rolling temperature through quenching at a cooling rate of at least 15° C./s to below 500° C., that it at the subsequent cold rolling is passed twice in the same direction through said cold rolling line which comprises at least two cold rolling mills in the initial part of the line, and after said initial cold rolling mills at least one annealing section and at least one pickling section, said strip, as it for the first time is passing the at least two cold rolling mills in the initial part of the line, being rolled with the dark coloured oxides which the strip has obtained in the hot condition of the strip during the initial process.

At the initial cold rolling of the stainless steel, when the dark coloured oxidic coatings on both sides of the strip steel are there, which oxidic coatings have been formed in connection with the initial process in the hot state of the steel, a crackling of the oxide scales will occur to some degree. This can be considered as an initial descaling operation, which can facilitate the efficient descaling that is performed later, after the annealing, before the strip is pickled. In order that the said initial crackling shall be possible to be utilised efficiently in order to facilitate later descaling and pickling it is desirable that it as far as possible is not eliminated in connection with the annealing, i.e. so that fissures or cracks in the oxide layers do not heal up at the annealing. According to still another aspect of the invention it is a purpose to avoid that effect, i.e. to a substantial degree preserve the initiated braking up of the oxide scales which is achieved through the initial cold rolling on the oxidic surface layers. According to this aspect of the invention, the invention is characterised in that in that the cast and/or hot rolled strip, which is dark coloured by oxides on the surfaces of the strips, remaining from the foregoing manufacturing of the said cast and/or hot rolled strip, is cold rolled in one ore more consecutive cold rolling passes reducing the strip thickness by 10–75% and crackling the oxide scales, i.e. so that cracks are produced in the oxide scales, that the strip then is annealed in a furnace having a furnace atmosphere which contains max 10 vol-% oxygen, preferably max 6 vol-% oxygen, and that the strip thereafter is pickled. The said furnace atmosphere can be obtained e.g. through the technique which is disclosed in WO95/24509, the content which herewith is incorporated in this text by reference. Typically the descaling is finished subsequent to annealing in a mode that has been described in the foregoing, i.e. through cold stretching in connection with bending the strip repeatedly about rolls and without surface destroying shot blasting.

Further characteristics and aspects of the invention will be apparent from the accompanying patent claims and from the following description of said rolling mill line and of how the invention can be reduced to practice according to a preferred embodiment.

DETAILED DESCRIPTION OF THE INVENTION

Figure 1B:
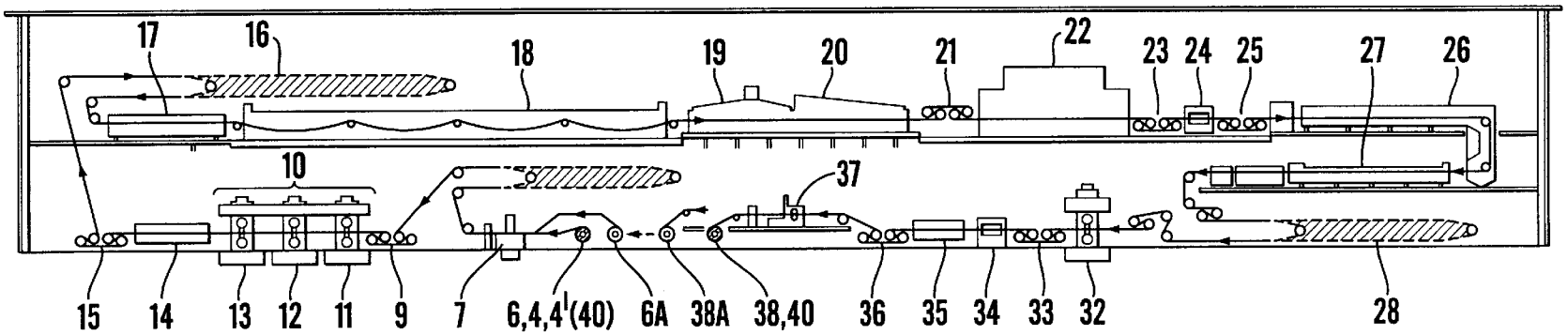
FIGS. 1A and 1B illustrate the invention and the rolling mill line semi-schematically, and in FIG. 2 the preferred embodiment of the method for manufacturing strips is illustrated very schematically.
Figure 1A:
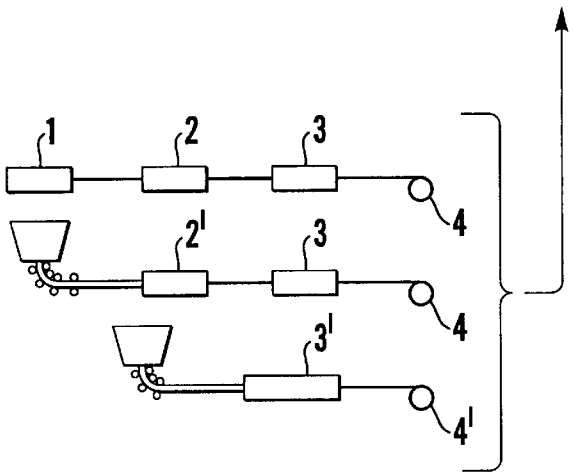

In the drawings, A schematically illustrates some different methods to manufacture the stainless strips, preferably strips of austenitic or ferritic stainless steel, which constitute starting material for the process in the subsequent rolling mill line B which is used for the carrying out of the method according to the invention. Also ferritic-austenitic steels are conceivable. Three methods of manufacturing the starting material are illustrated in the left hand part A of the drawings. According to method I, slabs 1 are hot rolled in a hot rolling mill line for the manufacturing of hot rolled strips with a thickness which can be normal for hot rolled strips, i.e. 1.5–6 mm. According to one aspect of the invention, however, the hot rolling is stopped before or at the latest when the thickness has been reduced to 2.5 mm, i.e. so that the strips obtain a thickness within the gauge range 3–6 mm, preferably a thickness between 3 and 5 mm. The hot rolled strips are quench-cooled to a temperature lower than 500° C. at a rate of at least 15° C./s in a quench-cooling section 3, suitably through intense water-spraying. Thereupon the strips are coiled into coils 4, which are caused to cool further to 100° C. or lower. Through the rapid cooling to below 500° C., precipitation of grain boundary carbides in the stainless steel strips are essentially avoided. Another effect attained through the rapid cooling is that those oxide layers which unavoidably are formed on the surfaces of the steel strip become thinner than what is normal in connection with hot rolling and slower cooling, particularly in connection with cooling after the strips have been coiled to form coils at a higher temperature.

According to method II stainless steel strips are cast to the shape of strips according to any technique which may be known per se and which as far as its specific mode of operation is concerned, does not form part of this invention and will therefore not be described more in detail. By way of example, however, there can be utilised so called stainless steel strip casting by twin rolls, which is a technique known by people skilled in the art. The cast stainless steel strip is hot rolled in a hot rolling mill line 2' to a thickness which is conventional for stainless, hot rolled strips, or somewhat larger, 3–6 mm, see above, whereupon the hot rolled strip immediately is quench-cooled in a cooling section 3 and is coiled to form a coil 4.

According to method III the stainless steel strip is cast in the shape of a strip having a thickness which is normal for stainless steel strips, or possibly somewhat larger, i.e. about 2.5–6 mm, whereupon the strip is quench-cooled in a cooling section 3' to a temperature below 500° C. at a rate which is sufficient to essentially avoid the formation of grain boundary carbides and for avoiding undesirably thick oxide scales on the surfaces of the strip, i.e. at a rate of at least 15° C./s. The thus produced strips are warned up on coils 4'.

The starting material for the subsequent operation in the rolling mill line B thus consists of the cast and/or hot rolled, stainless steel strips 4, 4'. Such a coil 4, 4' of a stainless steel strip is shown in the drawings as it is being decoiled from a decoiler 6. An auxiliary decoiler is designated 6A. A welding machine for splicing strips, a first strip looper, and a first multi-roll S-mill are designated 7, 8, and 9, respectively. Then follows an initial cold rolling section 10, consisting of three cold rolling mills 11, 12, and 13, which mills are of so called Z-high- or 6-high type, which means that each of them has a pair of working rolls and two support rolls over and under respective working roll.

After the initial cold rolling section 10 there follows a degreasing equipment 14, a second multi-roll S-mill 15 and a second strip looper 16.

The strip which has been decoiled from the coil 6 is designated 5 in the drawings. After having passed the initial cold rolling section 10, the strip is designated 5'. From the strip looper 16, the strip 5' is fist fed through a washing equipment 17 before it is fed into and through an annealing furnace 18 and a cooling section comprising two cooling chambers 19 and 20. Then there follows a third multi-roll S-mill 21, a shot blasting step 22 and a descaler 24. On each side of descaler 24 there is a fourth and a fifth multi-roll S-mill 23 and 25, respectively.

The descaler 24 consists of a cold stretch mill, the design of which is shown in detail in FIG. 3 in said EP 0 738 781, which herein is incorporated in the present description by reference. A cold stretch mill of that type comprises a series of rolls which force the strip to be bent alternatively in different directions, at the same time as the strip is permanently elongated through cold stretching. One has found that by means of a cold stretch mill of that type it is possible to achieve an efficient descaling without impairing the surfaces of the strip beneath the oxide layers.

After the descaler 24 there follows a pickling section, which e.g. can consist of an initial neolyte- or other electrolytic pickling section 26 and a mixed acid pickling section 27. The acid mixture e.g. may consist of a mixture of nitric acid, $HNO_3$, and hydrofluoric acid, HF. The pickled strip, which is designated 5", then can be stored in a third strip looper 28.

A further, terminating cold rolling mill is designated 32. This mill, according to the embodiment, consists of a four-high mill, i.e. a rolling mill with a couple of working rolls.and a supporting roll over and under the working roll, respectively, allowing rolling with reductions by up to 15 to 20% depending on the type of stainless steel (austenitic or ferritic, the ferritic steels normally being possible to be rolled with a higher degree of reduction than austenitic steels). Alternatively the finishing cold rolling mill may consist of a two-high mill intended only for skin-pass-rolling. Subsequent to the rolling mill 32 there are provided a sixth multi-roll S-mill 33, a straightening mill 34, a drying unit 36, a seventh S-mill 36, and an edge cutting unit 37 before the strip 5'" is wound up to form a coil 40 on a coiler 38. An auxiliary coiler has been designated 38A.

Figure 2:
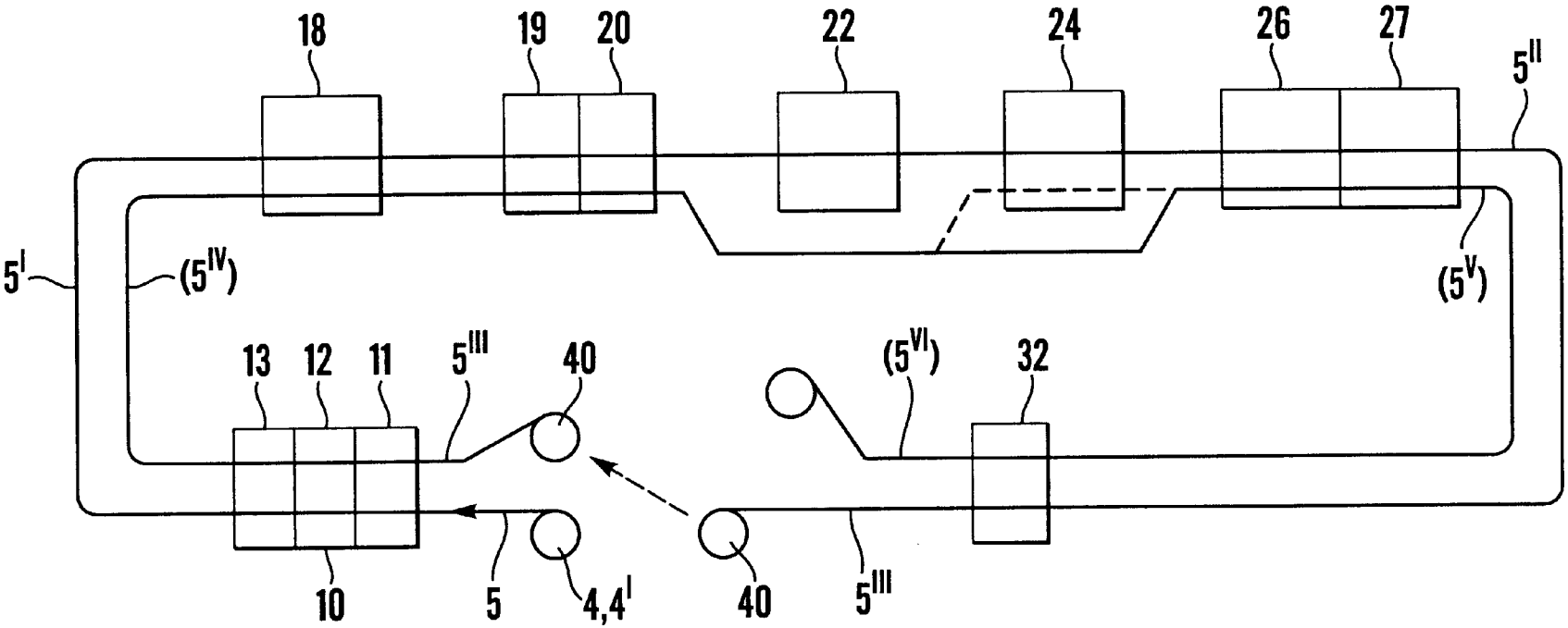

According to the various aspects of the invention, the stainless steel strip shall pass once or twice through the rolling mill line B. This will now be disclosed more in detail with reference to FIG. 2, in which only the most essential equipment have been shown, while other parts, such as a welding machine, S-mills, deflecting-and guide rollers, loopers, etc., have been left out in order that the principles of the invention shall be more clear. Reference numerals within brackets indicate strip material that is being processed as the material is passing the rolling mill line B for the second time.

The rolling in the rolling mill line B is initiated by unwinding the hot rolled or cast strip 5 of stainless steel from the coil 4, 4' of strip material. It then still has its dark, oxidic coating which it has obtained in the foregoing process in part A. This strip is cold rolled with a thickness reduction of totally at least 10% and max 75% in one, two, or all the three of the rolling mills 11, 12, 13 in the initial cold rolling section 10, preferably with 20–50% area reduction. The comparatively thin, dark oxide layers on the strip surfaces obtained at the quench-cooling after hot rolling or casting are so ductile that they are not broken apart through the cold rolling operations in the initial cold rolling section 10 to such a degree that they get loose from the substrate, i.e. from the metal surface. However, cracks are formed in the oxide layers, i.e. the scales on the steel strips crackle. This appears to be of essential importance for the subsequent pickling, the efficiency of which therein being promoted, which in its turn is important for the achievement of fine surfaces on the final product.

In the annealing furnace 18 the thus cold rolled strip 5' is annealed through heating to a temperature within the temperature range 1050–1200° C. for so long a period of time that the strip is through heated and recrystallised. According to an aspect of the invention, the furnace 18 contains max 10 vol-% oxygen, preferably max 6 vol-% oxygen. A furnace atmosphere of that character can be obtained and be maintained in different ways, e.g. and suitably therein that the furnace is heated by means of a burner consuming a liquid or gaseous fuel which is combusted by means of a gas which contains at least 85 vol-% oxygen and at most 10 vol-% nitrogen, as is described in said WO95/24509. In the atmosphere, which is poor of oxygen, in furnace 18, those surfaces of the steel strips, which are exposed through the cracks in the oxide, which have been formed through the cold rolling in the initial cold rolling section 10, are oxidised only to a small degree, which is favourable for the subsequent descaling, which preferably is carried out in the cold-stretch mill 24.

In the cooling chambers 20 the strip 5' is cooled to below 100° C., before it is mildly shot-blasted in the shot-blasting section 22, which is a first measurement for the removal of oxides and scales from the strip surfaces. More particularly, oxides which lay loosely are removed through the shot-blasting in order not to spoil the subsequent descaling through accumulation of oxides.

The strip is passed and is stretch-elongated in the descaler 24 between a plurality of rolls under repeated bending, wherein the oxide scales are broken as another, preparatory measurement prior to the pickling in the pickling units 26 and 27, where the oxide scales are completely removed.

The thus pickled strip 5" then is cold rolled also in the terminating, additional cold rolling mill 32, which is dimensioned such that it can reduce the thickness additionally by up to 20%. Preferably the strip gauge reduction in the finishing cold rolling mill 32 is at least 2% and normally not more than 15%, suitably at least 8% and max 12%. The strip 5''' then is wound up to form a strip coil 40.

Possibly, the descaling in the cold-stretch mill 24 can be completely omitted or is the cold stretching performed only to a small degree, about 0.5–2%, or about 1.5%. However, according to an aspect of the invention also more extended cold-stretching can be conceived, preferably however not more than 5%. If the cold-stretching is completely omitted, descaling is carried out through a mild blasting with steel shots in combination with brushing, a descaling type of treatment which can be made possible due to the initial cold rolling on oxidic surfaces and subsequent annealing in the specific atmosphere in the annealing furnace 18. Also the alternative "light permanent stretching (0.5–2%)+mild blasting and brushing" is conceivable. Thereafter the strip is pickled in the pickling section 26–27 and is finally coiled.

According to the first aspect of the invention then the strip is passed one more time through the rolling mill line in the same direction as during the first pass. According to another aspect of the invention the obtained product may be the final product.

According to the first aspect of the invention the strip coil 40, after a period of time, which depends, among other things, on the logistic planning of the production in the plant, is transported to the decoiler 6 or 6A in the starting position of the rolling mill line, where the strip (5''') again is decoiled for the second passage of the strip through the rolling mill line B. While the strip during the first passage possibly only was rolled in one or two of the rolling mills 11–13 in the initial cold rolling section 10, it is this time rolled in two or three of the mills 11–13 so that it essentially achieves the desired final gauge of the strip. The total thickness reduction in the rolling mill section 10 at the second passage of the strip through this section depends on the desired final gauge and can amount to totally 60% and to at least 20%, preferably to at least 30%. After having passed the cold rolling section 10 for the second time, the cold rolling of the strip, now designated ($\mathbf{5}^{IV}$), is finished. The final treatment consists of again passing the strip through the annealing furnace 18, the cooling chambers 19 and 20 and the pickling sections 26 and 27. However, it is this time not at all treated in the shot-blasting unit 22 or in the descaler 24 according to an aspect of the invention, since the oxidation of the strip surfaces on this occasion will be so insignificant that neither descaling in the cold stretch mill 24 nor blasting in the blasting mill 22 in necessary. The annealed strip therefore can, after cooling, immediately be pickled in the pickling units 26 and 27. The treatment is finished by skin-pass rolling 0.2–1.5%; preferably about 0.5% or by hard rolling 2–20%, preferably 10–15% in the cold rolling mill 32 and/or by straightening through stretching in the straightening mill 34 before final coiling.

According to another aspect of the invention it is, however, also during the second passage through the rolling mill line treated in the descaler 24, the purpose in this case being to increase the yield strength of the strip through cold stretching. In the terminating cold rolling mill 32 it is then possibly rolled one more time, but this time it is only skin-pass rolled with a reduction thickness of 0.2–1.5%, preferably about 0.5%, in order to provide desired fine surfaces. The treatment of the strip ($\mathbf{5}^{V}$) then is finished and the strip is coiled again. As an alternative, the strip ($\mathbf{5}^{V}$), instead of being skin-pass rolled, is rolled with the same heavy thickness reduction as when the strip was rolled for the first time in the terminating cold rolling mill 32, if the aim is to produce a strip with a very high yield strength.

The above description describes preferred embodiments according to different aspects of methods of using the rolling mill line B. It is a particular advantage of the design of the rolling mill line B that the rolling mill line or parts of it also can be used for processes which aims at manufacturing not only strips with very fine, bright surfaces but also strips with features which for some applications are of more significant importance than very bright surfaces, such as strips with high strength or strips with a lower degree of improvement but with advantages from a cost point of view. For the latter purpose, the treatment e.g. can be stopped already after the strip 5" has passed the pickling sections 26, 27 after the first passage of the first cold rolling section 10, the annealing and cooling sections, and the pickling sections. In the descaler 24 the strip can be cold stretched 2–10%, which provides a significant improvement of the strength. This treatment, however, also can be omitted, if such increase of the strength/yield strength is not desired. As an alternative the cold stretching can be replaced or completed by 2–20% cold rolling in the terminating cold rolling mill 32, which in that case is performed on non-lubricated surfaces, as the strip passes the terminating cold rolling mill a first time, whereafter the process is finished by coiling the strip.

Another variant of the embodiment in which the strip is passed only once through the rolling mill line B is the following. First the cast and/or hot rolled strip is rolled, with its dark oxides remaining on the surfaces, in at least one of the initial cold rolling mills 11–13 in the cold rolling section 10 by a total reduction of 10–75%, preferably 20–50% total reduction before it is annealed in the annealing furnace 18. The furnace atmosphere consists of the atmosphere described in the foregoing. After cooling the strip with its crackled, easily broken scales is blasted so gently that the metallic surfaces will not be impaired. The descaling possibly can be complemented in the cold stretch mill 24 through stretching 2–10%. Thereafter the strip is pickled in the pickling units 26 and 27. The pickled surfaces obtained therein are comparatively fine, allowing the strip to be used with these surfaces e.g. for construction details without any further surface treatment. Subsequent to pickling no more treatment is carried out than, if necessary, conventional straightening in the straightening mill 34, edge cutting, etc., and coiling.

These examples and alternatives illustrate the versatility and adaptability of the rolling mill line to various wants as far as the final product is concerned.

EXAMPLE

A slab of stainless austenitic steel of grade ASTM 304 is hot rolled in a Steckel-mill to achieve a strip with a breadth of 1530 mm and a thickness of 4.0 mm. Immediately upon rolling, the strip is quench-cooled from a final rolling temperature of about 900° C. to below 500° C. for about 10 s by water spraying, whereafter the strip is coiled. Through the fast cooling prior to coiling, formation of grain boundary carbides are essentially avoided. At the same time also the dark oxide layers on the surfaces of the strip become comparatively thin.

The strip coil then is transported to the rolling mill line of the invention, is decoiled, and is first cold rolled with its dark oxide layers in two of the rolling mills 11–13 in the initial cold rolling section 10 to the thickness of 2.05 mm, wherein the oxide layers crackle, however without loosening. Thereafter the strip is annealed in the annealing furnace 18 in the atmosphere poor of oxygen, which has been previously described, at a temperature of 1120° C. for a sufficiently long period of time in order to be completely recrystallised, whereafter the strip is cooled to below 100° C. in the cooling chambers 19 and 20. Then the surfaces of the strip is shot-blasted in the shot-blasting unit 22 very mildly with steel shots, whereafter the strip is subjected to descaling in the stretch mill 24, before it is pickled, first through electrolytic pickling in the section 26 and then in mixed acid (mixture of nitric acid, $HNO_3$, and hydrofluoric acid, HF) in the pickling section 27. In the finishing cold rolling mill 32 the pickled strip then is cold rolled with a thickness reduction of 9.8% to gauge 1.85 mm, whereafter the strip is wound up on a coil.

The strip then is transported back to the start position. Due to the heavy cold rolling which the strip has been subjected to in the terminating cold rolling operation in the rolling mill 32 it has been deformation hardened to a considerable degree and it is therefore not easily damaged and can therefore be transported and handled without a risk that the strip surfaces shall be damaged. The strip thus again is decoiled and it is this time rolled in all the three rolling mills 11–13 in the initial cold rolling mill 10 with a total thickness reduction of 45.9% to gauge 1.0 mm. The strip is annealed, cooled, and then pickled in the same way as during the first passage through the rolling mill line but is not shot-blasted or cold stretched prior to pickling according to the example. Finally the strip is skin-pass rolled in the terminating cold roll mill 32, adding a further thickness reduction of about 0.5%, wherein the strip achieves a surface fineness Ra_0.12 $\mu$m, i.e. very well corresponding to 2B-surface.

As is apparent from the foregoing, the cold rolling mill of the invention is extremely versatile as far as its use for the manufacturing of stainless strips with very fine surfaces and/or for strips with other desirable qualities or desired features are concerned. In the following table, there will be listed a number of these alternative ways of manufacturing strips with reference to the utilisation of the various thickness reducing units which are included in the rolling mill line, i.e. the initial cold rolling mills, the descaler/cold stretching mill, which also can be used for reducing the thickness of the strip, and the cold rolling mill, or possibly a plurality of cold rolling mills, which terminate the line.

Examples of different alternatives concerning the use of the cold rolling mill line with reference to strip thickness reductions

| | First passage through the cold rolling line | | | Second passage through the cold rolling line | | | |
|---|---|---|---|---|---|---|---|
| Alternative | Cold rolling section 10 | Descaler/cold stretching mill 24 | Cold rolling mill 32 | Cold rolling section 10 | Descaler/cold-stretching mill 24 | Cold rolling mill 32 | Achieved surface of the final product |
| 1 | Rolling in at least one of the mills 11, 12 and/or 13; 10–75%, preferably 20–50% total reduction | Permanent elongation 2–10% | Reduction of thickness 2–20%, preferably 3–15%, suitably 8–12% | Rolling in at least two of the mills 11, 12, and/or 13; 20–60% total reduction | — | Skin-pass rolling 0.2–1.5%; preferably about 0.5% reduction | At least 2B |
| 2 | Rolling in at least one of the mills 11, 12 and/or 13; 10–75%, preferably 20–50% total reduction | Permanent elongation 2–10% | — | Rolling in all the three mills 11, 12, and 13; 30–60% total reduction | — | Skin-pass rolling 0.2–1.5%; preferably about 0.5% reduction | At least 2B |
| 3 | Rolling in at least one of the mills 11, 12 and/or 13; 10–75%, preferably 20–50% total reduction | Permanent elongation 2–10% | Reduction of thickness 2–20%, preferably 3–15%, suitably 8–12% | Rolling in a least two of the mills 11, 12 and/or 13; 20–60% total reduction | Permanent elongation 2–10% | Hard rolling 2–20%, preferably 10–15% | At least 2B |
| 4 | Rolling in at least one of the mills 11, 12 and/or 13; 10–75%, preferably 20–50% total reduction | Permanent elongation 2–10% | — | Rolling in all the three mills 11, 12, and 13; 30–60% total reduction | Permanent elongation 2–10% | Hard rolling 2–20%, preferably 10–15% | At least 2B |
| 5 | Rolling in at least one of the mills 11, 12 and/or 13; 10–75%, preferably 20–50% total reduction | Permanent elongation 2–10% | Hard rolling 2–20%, preferably 10–15% | — | — | — | Very good (almost 2B) |
| 6 | Rolling in at least one of the mills 11, 12 and/or 13; 10–75%, preferably 20–50% total reduction | Omitted or permanent elongation 0.5–5% | — | Rolling in at least two of the mills 11, 12 and/or 13; 30–60% total | — | Skin-pass rolling 0.2–1.5%; preferably about 0.5% reduction or | At least 2B |

-continued

Examples of different alternatives concerning the use of the cold rolling mill line with reference to strip thickness reductions

| | First passage through the cold rolling line | | | Second passage through the cold rolling line | | | |
|---|---|---|---|---|---|---|---|
| Alternative | Cold rolling section 10 | Descaler/cold stretching mill 24 | Cold rolling mill 32 | Cold rolling section 10 | Descaler/cold-stretching mill 24 | Cold rolling mill 32 | Achieved surface of the final product |
| | | | | reduction | | hard rolling 2–20%, preferably 10–15% | |
| 7 | Rolling in at least one of the mills 11, 12 and/or 13; 10–75%, preferably 20–50% total reduction | Blasting + (optionally) permanent elongation 2–10% | — | — | — | — | Pickled surface |

What is claimed is:

1. A method for manufacturing strips of stainless steel, comprising cold rolling of a strip which in a foregoing process has been manufactured through casting a melt to form a cast strip and/or has been hot rolled, said cold rolling being performed in a rolling mill line which comprises, in an initial part of the mill line, at least two initial cold rolling mills in series, after said initial cold rolling mills at least one annealing furnace and at least one pickling section and, in a terminating part of the line, at least one further cold rolling mill, wherein the cast and/or hot rolled strip, which is dark colored by oxides on surfaces of the strip, with said dark colored oxides remaining on the surfaces of the strip, first is cold rolled in at least one of said initial cold rolling mills to reduce the thickness of the strip totally by 10–75%, then the strip is annealed and pickled in said annealing and pickling sections and is cold rolled in said at least one further cold rolling mill to reduce its thickness by 2–20%, then the strip fed once more in the same direction through the same rolling mill line, then the strip is rolled again in at least one of said initial cold rolling mills whereby the strip consecutively is cold rolled in at least one of said further cold rolling mills and in at least one of said initial cold rolling mills, comprising cold rolling in at least three cold rolling mills without intermediate annealing, reducing the thickness totally by 30–75% before the strip again is annealed and pickled.

2. Method according to claim 1, wherein the thickness of the stainless steel strip is reduced by 20–50% as it passes through said initial cold rolling section for the first time and by max 15% as it passes through the terminating cold rolling mill for the first time.

3. Method according to claim 1, wherein the thickness of the strip is reduced by 20–60% as it passes through said first cold rolling mill section for the second time.

4. Method according to claim 1, wherein the strip is skin-pass rolled about 0.5% as it passes through said terminating cold rolling mill for the second time.

5. Method according to claim 1, wherein the strip is hard-rolled 2–20% as it passes through said terminating cold rolling mill for the second time.

6. Method according to claim 1, wherein the strip is hard-rolled 10–15%, as it passes through said terminating cold rolling mill for the second time.

7. Method for the manufacture of strips of stainless steel, comprising cold rolling of a strip which in a foregoing process has been manufactured through casting a melt to form a cast strip and/or has been hot rolled, wherein the cold rolling is performed in a rolling mill line which comprises, in an initial part of the line, at least two initial cold rolling mills in series, after said initial cold rolling mills at least one annealing furnace and at least one pickling section and, in a terminating part of the line, at least one further cold rolling mill, wherein the cast and/or hot rolled strip, which is dark colored by oxides on the surfaces of the strip, with the dark colored oxides remaining on the surfaces of the strip, first is cold rolled in at least one of said initial cold rolling mills so that the thickness of the strip is reduced totally by 10–75%, then the strip is annealed and pickled in said annealing and pickling sections and is cold rolled in said at least one further cold rolling mill reducing the thickness by max 1.5%, and then the strip is fed once more in the same direction through the same rolling mill line, at which the strip is rolled in at least three initial cold rolling mills, reducing the thickness totally by 30–75%, before the strip again is annealed and pickled.

8. Method accordingly to claim 7, wherein the cast and/or hot rolled strip, which is dark colored by oxides on the surfaces of the strip, with the dark colored oxides remaining on the surfaces of the strip, first is cold rolled in at least one of said initial cold rolling mills so that the thickness of the strip is reduced totally by 10–75%, secondly the strip is annealed and pickled in said annealing and pickling sections but is not worked in said at least one further cold rolling mill.

9. Method for the manufacture of strips of stainless steel, comprising cold rolling of a strip which in a foregoing process has been manufactured through casting a melt to form a cast strip and/or has been hot rolled, wherein the cold rolling is performed in a rolling mill line which comprises, in an initial part of the line, at least two initial cold rolling mills in series, after said initial cold rolling mills at least one annealing section and at least one pickling section and, in a terminating part of the line, at least one further cold rolling mill, wherein the cast and/or hot rolled strip, which is dark colored by oxides on the surfaces of the strip, with the dark colored oxides remaining on the surfaces of the strip, first is cold rolled in at least one of said initial cold rolling mills so that the thickness of the strip is reduced totally by 10–75%, then the strip is annealed in at least one annealing furnace in an annealing section, then the strip subsequent to annealing and rolling is subjected to descaling in at least one descaling unit in which the strip is bent several times in different directions about rollers at the same time as the strip is cold-stretched, so that the strip is permanently elongated 2–10%, wherein the scales are caused to be broken, then the strip is pickled, and the pickled strip is then cold rolled in a non-lubricated condition in said at least one further cold rolling mill reducing the thickness by 2–20%.

10. Method for the manufacture of strips of stainless steel, comprising hot rolling in an initial process and subsequently cold rolling in a rolling mill line, said hot rolling being stopped when the strip thickness has been reduced to a thickness between 2.5 and 6 mm, said hot rolled strip being cooled from a final hot rolling temperature through quenching at a cooling rate of at least 15° C./s to below 500° C., said strip at the subsequent cold rolling being passed twice in the same direction through said cold rolling line which comprises at least two cold rolling mills in an initial part of the line and, after said initial cold rolling mills, at least one annealing section and at least one pickling section, said strip, as it for the first time passes the at least two cold rolling mills in the initial part of the line, being rolled with the dark colored oxides remaining which oxides the strip has obtained in the hot condition of the strip during said initial process.

11. Method according to claim 10 wherein the hot rolling is stopped when the strip thickness has been reduced to a thickness between 3 and 5 mm.

12. Method for the manufacture of strips of stainless steel, comprising cold rolling of a strip which in a foregoing process has been manufactured through casting a melt to form a cast strip and/or has been hot rolled, said cast and/or hot rolled strip, which is dark colored by oxide scales on the surfaces of the strips, remaining from the foregoing manufacturing of said cast and/or hot rolled strip, being cold rolled in one or more consecutive cold rolling passes reducing the strip thickness by 10–75%, forming cracks in said oxide scales, annealing the strip in a furnace having a furnace atmosphere which contains max 10 vol-% oxygen, and pickling the strip.

13. Method according to claim 12 wherein the strip is annealed in a furnace having a furnace atmosphere containing max 6 vol-% oxygen.

14. Method for the manufacture of strips of stainless steel, comprising cold rolling of a strip which in a foregoing process has been manufactured through casting a melt to form a cast strip and/or has been hot rolled, wherein the cold rolling is performed in a rolling mill line which comprises, in an initial part of the line, at least two initial cold rolling mills in series, after said initial cold rolling mills at least one annealing furnace containing a furnace atmosphere obtainable by heating the furnace by means of a burner which consumes a liquid or gaseous fuel which is combusted by means of a gas which contains at least 85 vol-% oxygen and at most 10 vol-% nitrogen; after the annealing furnace at least one pickling section and, in a terminating part of the line, at least one further cold rolling mill, the cast and/or hot rolled strip, which is dark colored by oxides on the surfaces of the strip, initially is cold rolled in at least one of said initial cold rolling mills with the dark colored oxides remaining on the surfaces of the strip, so that the thickness of the strip is reduced by totally 10–75%, said strip then being annealed in said annealing furnace containing said furnace atmosphere and pickled in said at least one pickling section.

15. Method according to claim 14, wherein the strip after said pickling is not cold rolled in said at least some more cold rolling mill, but is passed one more time in the same direction through said rolling mill line, wherein the strip is again rolled in at least two of said initial cold rolling mills by a total reduction of 30–60%, whereafter the strip again is annealed in said furnace atmosphere in said annealing furnace and is pickled.

16. Method according to claim 15, wherein the strip after said final pickling is skin-pass rolled 0.2–1.5% or is hard rolled 2–20% and/or is stretch-straightened providing a permanent elongation of 2–10%.

17. Method according to claim 2, wherein the strip is cold rolled, reducing its thickness by at least 3 and max 12% as it passes through said terminating cold rolling mill for the first time.

18. Method according to claim 14, wherein the strip is cold rolled, reducing its thickness by at least 8 and max 12% as it passes through said terminating cold rolling mill for the first time.

19. Rolling mill line for cold rolling stainless steel strips, comprising initial cold rolling strips having dark colored, oxidic surfaces, obtained at a foregoing manufacturing process through strip casting and/or hot rolling of stainless steel strips, further comprising, in an initial part of the rolling mill line, a cold rolling line comprising at least two cold rolling mills in series, in the terminating part of the line, at least one terminating cold rolling mill, and at least one annealing section and at least one pickling section between said initial cold rolling section and said terminating cold rolling mill.

20. Rolling mill line according to claim 19, wherein said initial cold rolling mills in series reduce the thickness of a hot rolled or cast strip by totally at least 10% and max 75%, said terminating cold rolling mill reducing the thickness of an annealed and pickled stainless steel by up to 20% and being useable for skin-pass-rolling of a pickled stainless strip.

21. Rolling mill line according to claim 20, wherein said initial cold rolling mills in series reduce the thickness of a hot rolled or cast strip by totally at least 20% and max 75%.

22. Rolling mill line according to claim 19, wherein said initial cold rolling mills in series reduce the thickness of a hot rolled or cast strip by totally at least 10% and max 75%, and said terminating cold rolling mill is a skin-pass-rolling mill.

23. Rolling mill line according to claim 22, wherein the thickness of the hot rolled or cast strip is reduced by totally at least 20% and max 75%.

24. Rolling mill line according to claim 19, wherein each of the cold rolling mills in the initial part of the line comprises a pair of working rolls and at least two supporting rolls over and under a respective working roll, said at least one cold rolling mill in the terminating part of the line consisting either of a four-high rolling mill comprising a pair of working rolls and at least one supporting roll over and under a respective working roll, or consisting of a two-high rolling mill for skin-pass-rolling.

25. Rolling mill line according to claim 19, wherein a descaler is provided between the annealing and pickling sections in the form of a cold-stretching mill, in which the strip is provided to be bent alternately in different directions about a plurality of rolls at the same time as the strip is permanently being stretched.

* * * * *